United States Patent [19]

Ochiai et al.

[11] Patent Number: 4,820,338

[45] Date of Patent: Apr. 11, 1989

[54] MAGNETIC POWDER COMPOSITION

[75] Inventors: Kumi Ochiai, Yokohama; Hiromichi Horie, Yokosuka; Itsuo Arima, Kawasaki; Mikio Morita, Yokohama, all of Japan

[73] Assignee: Kabushiki Kaisha Toshiba, Kawasaki, Japan

[21] Appl. No.: 930,942

[22] Filed: Nov. 17, 1986

Related U.S. Application Data

[63] Continuation of Ser. No. 660,930, Oct. 15, 1984, abandoned.

[30] Foreign Application Priority Data

Nov. 16, 1983 [JP] Japan ..... 58-215237

[51] Int. Cl.[4] ..... H01F 1/09; H01F 1/26

[52] U.S. Cl. ..... 75/233; 428/900; 252/62.54

[58] Field of Search ..... 428/900; 252/62.53, 252/62.54, 62.55; 360/134; 427/128; 556/182; 75/246, 233, 235

[56] References Cited

U.S. PATENT DOCUMENTS

| | | | |
|---|---|---|---|
| 3,859,130 | 1/1975 | Parker et al. | 428/480 |
| 4,007,313 | 2/1977 | Higuchi | 428/447 |
| 4,007,314 | 2/1977 | Higuchi | 428/447 |
| 4,076,890 | 2/1978 | Yamada et al. | 428/337 |
| 4,196,258 | 4/1980 | Huisman | 428/447 |
| 4,374,760 | 2/1983 | Charles | 252/518 |
| 4,397,751 | 8/1983 | Dickstein | 252/62.54 |
| 4,415,630 | 11/1983 | Kubota | 428/403 |
| 4,444,850 | 4/1984 | Matsufuji | 428/694 |
| 4,448,848 | 5/1984 | Okita | 428/447 |
| 4,529,649 | 7/1985 | Takeuchi | 428/328 |

FOREIGN PATENT DOCUMENTS 0088992 9/1983 European Pat. Off. .

OTHER PUBLICATIONS

Tanaka et al, Japanese Journal of Applied Physics, Sep. 1967, pp. 1096–1100.

Hausner, Handbook of Powder Metallurgy, 1973, p. 8.

*Primary Examiner*—John F. Terapane

*Assistant Examiner*—Eric Jorgensen

*Attorney, Agent, or Firm*—Oblon, Fisher, Spivak, McClelland & Maier

[57] ABSTRACT

A magnetic powder composition suitable for manufacturing a powder core used in a reactor or transformer connected to a semiconductor switching element, essentially consists of a powder of a soft magnetic metal or alloy or a mixture of these, an electrically insulating binder polymer for binding the powder, and a coupling agent of an organic metallic compound for coupling the powder and the binder polymer. The obtained powder core has excellent frequency characteristics of magnetic permeability, a high magnetic flux density, and a small iron loss at high frequencies.

15 Claims, 4 Drawing Sheets

MAGNETIC POWDER COMPOSITION

This application is a continuation of application Ser. No. 660,930, filed Oct. 15, 1984 now abandoned.

BACKGROUND OF THE INVENTION

1. Field of the Invention

The present invention relates to a magnetic powder composition and, more particularly, to a magnetic powder composition suitable for manufacturing a compressed powder core in which electric insulation between magnetic powder particles is improved.

2. Description of the Prior Art

In the prior art, in electrical instruments such as an electric power converting device, including a device for converting an alternate current to a direct current, a device for converting an alternate current having a certain frequency to another alternate current having a different frequency and a device for converting a direct current to an alternate current such as so called inverter, or a non-contact breaker, etc., there have been employed, as electrical circuit constituent elements thereof, semiconductor switching elements, typically thyristor and transistor, and reactors for relaxation of turn-on stress in a semiconductor switching element, reactors for forced commutation, reactors for energy accumulation or transformers for matching connected to these elements.

Iron cores used in such reactors or transformers are conventionally classified as follows:

(a) So called laminated iron cores produced by laminating thin electromagnetic steel plates or permalloy sheets with an insulating interlayer interposed therebetween.

(b) So called dust cores obtained produced by a powder such as a carbonyl iron or permalloy powder with kaolin or a polymeric binder such as a phenol resin.

(c) So called ferrite cores produced by sintering an oxide magnetic material.

Such iron cores used in reactors or transformers which are connected to the semiconductor switching elements must satisfy specific magnetic property requirements. For example, such an iron core must have good frequency characteristics of magnetic permeability, high magnetic flux density, and small iron loss at high frequencies. Especially when a semiconductor switching element is operated, in addition to a current having a period of a switching frequency, a current having a frequency component which is far higher than the switching frequency, e.g., several tens of kilohertz to 500 kHz or higher, may flow in the iron core. In view of these, the iron core must definitely have good characteristics in a high-frequency range.

Of the three types of iron cores, although laminated iron cores exhibit excellent electrical characteristics within a commercial frequency range, they are subject to a large iron loss within a high-frequency range. In particular, in a laminated iron core, the eddy current loss increases in proportion to a square of the frequency. Furthermore, with an increase in the depth from the surface of the plate or sheet material constituting the iron core, the magnetizing force is less subject to changes due to the skin effect of the iron core material. Therefore, the laminated iron core can only be used at a magnetic flux density which is far lower than a saturated magnetic flux density of the laminated iron core material in a high-frequency range. The laminated iron core also has a very large eddy current loss.

In addition to the above disadvantages, laminated iron cores have a very low effective magnetic permeability at high frequencies as compared to an effective magnetic permeability within a commercial frequency range.

When a laminated iron core having these problems is used for a reactor or transformer connected to a semiconductor switching element through which a high-frequency current flows, the iron core itself must be rendered large so as to compensate for the low effective magnetic permeability and magnetic flux density. When the iron core is thus rendered large, the iron loss of the iron core is increased, and the length of the coil windings wound around the iron core is also increased, thereby increasing copper loss.

Dust cores, as the second types of iron core described above, are also conventionally used as iron cores. For example, Japanese Patent Registration No. 112,235 discloses the manufacture of a dust core for use as an iron core by compressing and forming a mixture of an iron powder or an ion alloy powder with an organic or inorganic binder and heating the formed mixture.

However, a dust core prepared in this manner generally has a low magnetic flux density and a low magnetic permeability. Even a dust core prepared using a carbonyl iron powder having a relatively high magnetic flux density has a magnetic flux density at a magnetizing force of 10,000 A/m of slightly higher than 0.1 T and a magnetic permeability of about $1.25\times10^{-5}$ H/m. Therefore, in a reactor or transformer using such a dust core as an iron core material, the iron core must be rendered large in order to compensate for a low magnetic flux density and a low magnetic permeability. With such an increase in the size of the iron core, the coil windings become longer, also resulting in a large copper loss of the reactor or transformer.

Ferrite cores, as the third type of iron cores, are frequently used for small electric equipment and have a high specific resistance and relatively good high-frequency characteristics. However, a ferrite core has a low magnetic flux density of about 0.4 T at a magnetizing force of 10,000 A/m. In addition to this, the permeability and the magnetic density at the same magnetizing force change by several tens of percentages within a temperature range of −40° to +120° C., which is the temperature range wherein the iron core is used. Thus, when a ferrite core is used as an iron core material of a reactor or transformer connected to a semiconductor switching element, the iron core must be rendered large to compensate for a low magnetic flux density, resulting in the same problem as with the two other types of iron cores.

Furthermore, since ferrite is a sintered body, the manufacture of a large iron core with ferrite is difficult. For this reason, it is difficult to use a ferrite core for handling high power. Due to the longer coil windings and larger copper loss owing to a low magnetic flux density and the great temperature dependencies of magnetic permeability and magnetic flux density, when a ferrite core is used for a reactor or transformer, the core is subject to great variations in its characteristics. When a ferrite core is compared with an electromagnetic steel plate or the like, it has a higher magnetostriction and generates a higher noise from the iron core.

SUMMARY OF THE INVENTION

It is an object of the present invention to provide a magnetic powder composition which can be suitably used for the manufacture of a powder core, in particular, a powder core used for a reactor or transformer connected to a semiconductor switching element.

It is another object of the present invention to provide a powder core which is manufactured from the above magnetic powder composition and which has excellent frequency characteristics of magnetic permeability, high magnetic flux density, and small iron loss at high frequencies.

The magnetic powder composition of the present invention esentially consists of:

(a) a magnetic powder of a soft magnetic metal or alloy, or a mixture thereof;

(b) an electrically insulating polymer for binding the powder; and (c) an organometallic coupling agent for accelerating coupling between the powder and the polymer.

In the second aspect, the present invention is directed to a powder core manufactured by compressing and forming the above-mentioned composition and heating the formed composition to a sufficient temperature for curing the polymer.

When the composition further contains a powder of an inorganic compound having an electrical insulating property, the forming or packing density of the powder core can be increased, and at the same time the effective electric resistance against AC magnetization of the overall powder core can be improved.

DETAILED DESCRIPTION OF THE PREFERRED EMBODIMENTS

Figure 1:
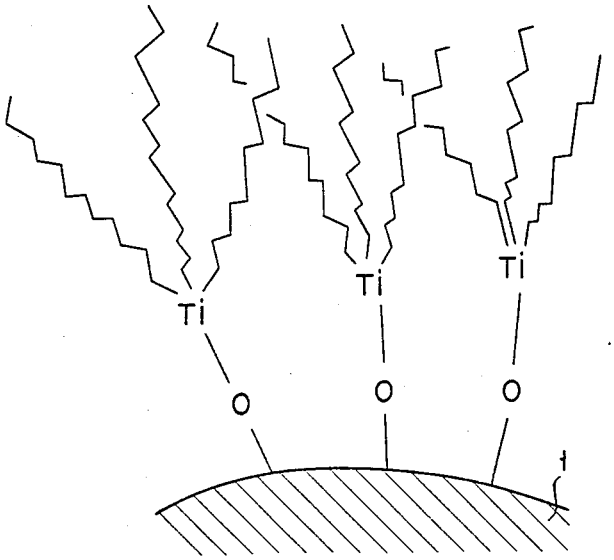
FIG. 1 is a representation showing a state wherein a titanium coupling agent is bonded to the surfaces of the magnetic powder particles.

A magnetic powder used in the composition of the present invention is pure iron or alloys such as an Fe—Si alloy (e.g., Fe-3% Si), an Fe—Al alloy, an Fe—Si—Al alloy, an Fe—Ni alloy such as a permalloy, or an Fe—Co alloy. An amorphous magnetic alloy consisting of at least one of Fe, Co, Ni and Nb, and at least one of Si, B, and C can also be used.

The magnetic powder has a specific electrical resistance of from 10 $\mu\Omega$-cm to several tens of micro-ohm centimeters. In view of this, in order to obtain satisfactory iron core material characteristics with an AC current including high-frequency components which would cause the skin effect, the magnetic powder must be formed into a fine powder to allow contribution to magnetization from the surface right to the inside of each particle.

In an iron core which is excited with a current having frequency components of up to several tens of kilohertz and which must therefore have good magnetic permeability characteristics up to such a frequency range, the magnetic powder preferably has an average particle size of 300 $\mu$m or less. In an iron core excited with a current having frequency components exceeding 100 kHz and which must therefore have good magnetic permeability characteristics up to such a frequency range, the magnetic powder preferably has an average particle size of 100 $\mu$m or less. However, when the average particle size of the magnetic powder becomes as small as 10 $\mu$m or less, it is hard to obtain an iron core from such a fine powder. Furthermore, even if such a fine powder is obtained, when the powder is compressed, a satisfactory density of the resultant iron core cannot be obtained with a compression pressure below 1,000 MPa. This imposes a problem of a low magnetic flux density. In view of this, the magnetic powder preferably has a particle size of 10 $\mu$m or more.

The magnetic powder is preferably contained in the composition in an amount of 55 to 99% by volume. When the amount of the magnetic powder exceeds 99% by volume, the resin content has a binder becomes too small and the binding power of the iron core becomes weak. However, when the amount of the magnetic powder is below 55% by volume, the magnetic flux density at a magnetizing force of 10,000 A/m is lowered to an equivalent to that obtained with ferrite.

An electrically insulating polymer is used herein as a binder for binding each particle of the magnetic material. At the same time, the polymer serves to cover the surface of each particle of the magnetic powder to electrically insulate one particle from another, thereby providing a satisfactory and effective electrical resistance for an AC magnetization of the overall iron core. Such a binder may, for example, be an epoxy resin, a polyamide resin, a polyimide resin, a polyester resin, or a polycarbonate resin. Such polymers may be used singly or in an admixture of more than one. The polymer is preferably used in the amount of 0.7% by volume or more based on the total volume of the composition. When the amount of the polymer used is less than 0.7% by volume, the binding force of the iron core is deteriorated.

A coupling agent used herein serves to improve wettability and adhesion between the magnetic powder and the binder resin. Due to these effects, the binder resin is introduced well between the magnetic powder particles to improve electrical insulation. Consequently, the iron loss of the iron core is reduced and the releasing force of the compressed body from the mold can be low.

Examples of the coupling agent which may be used herein preferably include a titanium coupling agent, a silane coupling agent, an aluminium coupling agent but may also include an indium coupling agent or a chromium coupling agent. Among these, a Ti, silane or Al coupling agent having a particularly good adhesion force with the magnetic powder is particularly preferable.

The Ti coupling agent has the following general formula:

$$R_m—Ti—X_n$$

wherein R is a group which is easily hydrolyzed, X is a lipophilic group which is not easily hydrolyzed, and m and n are positive integers. Since Ti has a coordination number of 4 or, 6, m+n must be 4 to 6 and m must fall within a range of 1 to 4.

The group R which is easily hydrolyzed is a monoalkoxyl group, a hydroxyacetic acid residue, or an ethylene glycol residue. Such a group R readily reacts with water adsorbed in the surface of each magnetic power particle at room temperature to be hydrolyzed. Then, as shown in FIG. 1, for example, Ti atoms of the Ti coupling agent are strongly bonded to the surface of a magnetic powder 1 through oxygen atoms O. The group X is one of several lipophilic groups including hydrocarbon moiety. The group X does not react with the hydroxyl group on the magnetic powder surface and has good wettability and adhesion with the binder polymer which is an organic material.

Examples of such a Ti coupling agent are enumerated below:

① isopropyltriisostearoyl titanate

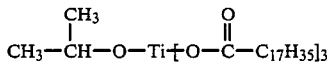

② dicumylphenyloxyacetate titanate

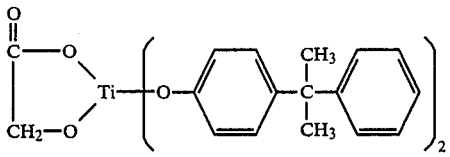

③ 4-aminobenzenesulfonyl dodecylbenzenesulfonyl ethylene titanate

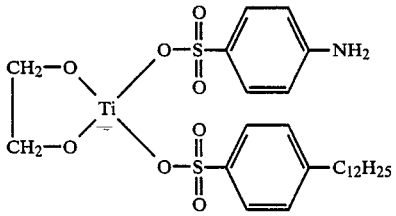

④ isopropyl tri(N-aminoethyl-amino-ethyl)titanate

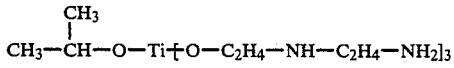

⑤ tetraoctyl bis(ditridecylphosphite)titanate $(C_8H_{17}-O)_4Ti\cdot[P-(O-C_{13}H_{27})_2OH]_2$ ⑥ tetra(2,2-diallyloxymethyl-1-butyl)bis(ditridecylphosphite)titanate

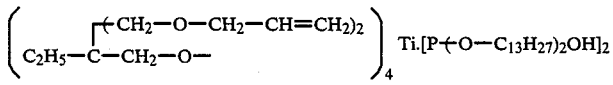

These Ti coupling agents are available from Kenrich Petrochemical Co., U.S.A.

Figure 2:
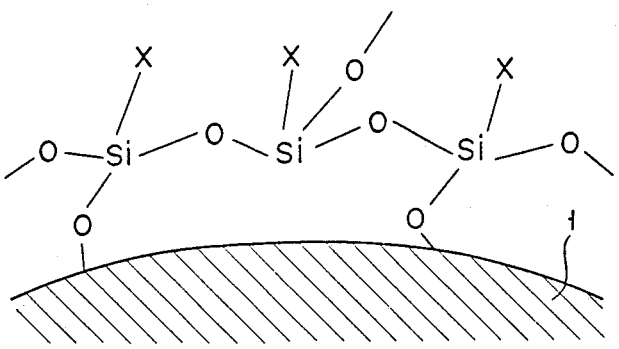
FIG. 2 is a representation showing a state wherein a silane coupling agent is bonded to the surfaces of the magnetic powder particles.

The silane coupling agent has the following general formula:

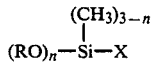

wherein RO is an alkoxy group, and X is an organic functional group. Since Si has a coordination number of 4, n is 2 or 3. The alkoxyl group RO may be a methoxyl group or an ethoxyl group. The RO group is hydrolyzed by water adsorbed in the magnetic powder surface or in air to produce a silanol group —SiOH. Then, as shown in FIG. 2, for example, silicone atoms Si of the silane coupling agent are strongly coupled to the surface of the magnetic powder 1 through oxygen atoms O. The organic functional group X may be an epoxy group, a methacryl group or an amino group and has good wettability and adhesion with the binder polymer.

Examples of such a silane coupling agent are enumerated below:

① γ-glycidoxypropyl trimethoxysilane

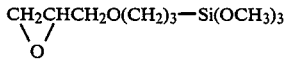

② β-(3,4-epoxycyclohexyl)ethyltrimethoxysilane

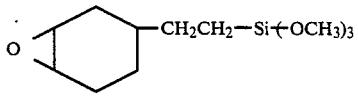

③ γ-aminopropyl triethoxysilane $H_2N(CH_2)_3-Si-(OC_2H_5)_3$

④ N-β(aminoethyl)-γ-aminopropyl methyldimethoxysilane

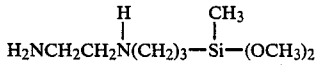

These silane coupling agents are available from Union Carbide Co., U.S.A.

The Al coupling agent has the following general formula:

$(RO)_n-Al-X_{3-n}$ wherein RO is an alkoxyl group, and X is a lipophilic group including a hydrocarbon moiety. The RO group may be a methoxy group, an ethoxy group, an isopropoxyl group, or a secondary butoxy group. The RO group is hydrolyzed by water in the air or water adsorbed in the magnetic powder surface and can therefore be coupled to the surface of the magnetic powder through oxygen atoms O of the coupling agent. Al generally has a coordination number of 3, and so n is 1 or 2. However, an another part of the lipophilic groups X are at times weakly coupled to aluminum atom which then has a pseudo coordination number of 4. In this case, the coupling agent is less subject to decomposition and is preferable.

An example of such an Al coupling agent is ethylacetoacetate aluminum diisopropylate having the structural formula:

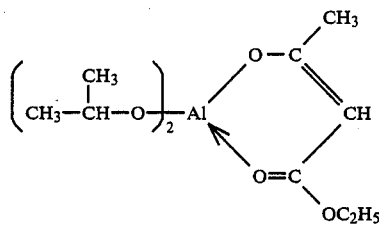

According to the present invention, the coupling agent is preferably contained in the amount of 0.3% by volume based on the total volume of the composition. When the amount of the coupling agent is less than 0.3% by volume, the polymer cannot completely surround the magnetic powder particles, resulting in poor insulation and an unsatisfactory reduction in iron loss.

The composition of the present invention may further contain a powder of an inorganic compound. The inorganic compound particles serve to reduce the friction between the magnetic powder particles during formation of the iron core so as to increase the forming density of the iron core. The inorganic compound particles are also present between the conductive magnetic powder particles to increase the effective electrical resistance for the AC magnetization of the overall iron core, thereby reducing iron loss. Such an inorganic compound may be calcium carbonate, magnesium carbonate, magnesia, silica, alumina, mica and various types of glass. A selected inorganic compound may not react with the magnetic powder or binder polymer described above.

The average particle size of the inorganic compound is preferably smaller than that of the magnetic powder particles in consideration of providing good dispersion and iron core material characteristics and is preferably 20 μm or less.

The inorganic compound is preferably contained in the amount of 0.3 to 30% by volume based on the total volume of the composition. When the amount of the inorganic compound is less than 0.3% by volume, a desired effect cannot be obtained by addition of this compound. However, when the amount of the inorganic compound exceeds 30% by volume, the resultant iron core has a poor mechanical strength.

A method of manufacturing an iron core from the composition of the present invention will be described below.

First, a magnetic powder and a coupling agent are mixed together with or without dissolving the coupling agent in a suitable solvent thereof such as isopropanol, toluene, or xylene. Upon this step, the surface of the magnetic powder is covered with the coupling agent. Next, a binder polymer is added to the mixture and the resultant mixture is well stirred.

In the mixing step described above, three components i.e., the magnetic powder, the binder polymer and the coupling agent can be well mixed simultaneously. Also, the magnetic powder can be mixed with a mixture of the binder polymer and the coupling agent.

A mixture containing a powder of an electrically insulating inorganic compound can be prepared by various methods including a method of mixing a magnetic powder and a powder of an inorganic compound and then sequentially adding a coupling agent and a binder polymer to the mixture; a method of simultaneously adding all of a magnetic powder, a powder of an inorganic compound, a binder polymer, and a coupling agent; and a method of dispersing a powder of an inorganic compound in a binder polymer before mixing it with other components. Although any such method can be adopted, a better effect is obtained if a powder of an inorganic compound is dispersed in a binder polymer before mixing it with other components.

The resultant mixture is charged in a mold and compressed in accordance with a conventional method to prepare a formed body having a desired shape. The formed body is heat-treated for curing the polymer, as needed, thereby manufacturing an iron core.

EXAMPLES

Although the present invention will be described by way of examples below, it is to be understood that the present invention is not limited thereto.

EXAMPLES NOS. 1-25

A magnetic powder, a binder polymer, a Ti coupling agent, and when applicable, a powder of an inorganic compound were well mixed. The resultant mixture was charged into a mold and compressed at a pressure of 600 MPa. After the compressed body was released from the mold, it was heat-treated to prepare an iron core. In each case, the powder of the inorganic compound was dispersed in the binder polymer before mixing it with other components except for that of Example No. 24. In the iron core of Example No. 24, all the components were mixed simultaneously. The heat-treatment was performed at 160° to 200° C. for 0.5 to 2 hours for the iron cores which used an epoxy resin as a binder polymer and at 160° C. for 15 minutes for the iron cores which used a polyamide resin as a binder polymer.

The mixing ratios of the respective components used are shown in Tables 1 to 4 below.

Iron cores of Comparative Example Nos. 26 to 40 were prepared following the same procedures as those of Examples except that no coupling agent was contained or only a small amount of a coupling agent was contained in the compositions of these Comparative Examples.

Annular samples of the obtained iron cores were subjected to measurements of magnetic properties such as iron loss within a frequency range of 50 Hz to 200 kHz, magnetic permeability and effective permeability within a DC voltage frequency of up to 10 MHz and magnetic flux density.

Of the obtained measurement results, Tables 1 to 4 show only iron loss at 50 kHz and 100 kHz at a typical magnetic flux density: B=0.05 T.

The releasing force for releasing the formed body from the mold in a step of compressing a columnar iron core having a diameter and a height of 20 mm was also measured.

TABLE 1

| | Magnetic powder | | | Binder polymer | | Ti coupling agent | | Inorganic compound powder | | | Iron loss (W/kg); B = 0.05T | |
|---|---|---|---|---|---|---|---|---|---|---|---|---|
| | Composition (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| Example | | | | | | | | | | | | |
| No. 1 | 3.5% Si—Fe | 54 | 85.0 | Epoxy | 14.7 | Tetraoctylbis-(ditridecylphosphite)titanate | 0.3 | — | — | — | 247 | 692 |
| No. 2 | 3.5% Si—Fe | 54 | 85.0 | Epoxy | 14.3 | Tetraoctylbis-(ditridecylphosphite)titanate | 0.7 | — | — | — | 215 | 519 |
| No. 3 | 3.5% Si—Fe | 54 | 85.0 | Epoxy | 13.0 | Tetraoctylbis-(ditridecylphosphite)titanate | 2.0 | — | — | — | 199 | 480 |
| No. 4 | 3.5% Si—Fe | 54 | 85.0 | Epoxy | 10.7 | Tetraoctylbis-(ditridecylphosphite)titanate | 0.3 | $CaCO_3$ | 2.8 | 4.0 | 235 | 662 |
| No. 5 | 3.5% Si—Fe | 54 | 85.0 | Epoxy | 9.5 | Tetraoctylbis-(ditridecylphosphite)titanate | 2.0 | $CaCO_3$ | 2.8 | 3.5 | 131 | 327 |
| No. 6 | 3.5% Si—Fe | 54 | 85.0 | Epoxy | 8.4 | Tetraoctylbis-(ditridecylphosphite)titanate | 3.5 | $CaCO_3$ | 2.8 | 3.1 | 123 | 309 |
| No. 7 | 3.5% Si—Fe | 54 | 85.0 | Epoxy | 6.9 | Tetraoctylbis-(ditridecylphosphite)titanate | 5.5 | $CaCO_3$ | 2.8 | 2.6 | 122 | 293 |
| Comparative Example | | | | | | | | | | | | |
| No. 26 | 3.5% Si—Fe | 54 | 85.0 | Epoxy | 14.9 | Tetraoctylbis-(ditridecylphosphite)titanate | 0.1 | — | — | — | 338 | 986 |
| No. 27 | 3.5% Si—Fe | 54 | 85.0 | Epoxy | 10.8 | Tetraoctylbis-(ditridecylphosphite)titanate | 0.1 | $CaCO_3$ | 2.8 | 4.1 | 305 | 889 |
| No. 28 | 3.5% Si—Fe | 54 | 85.0 | Epoxy | 15.0 | — | — | — | — | — | 368 | 1,127 |
| No. 29 | 3.5% Si—Fe | 54 | 85.0 | Epoxy | 10.9 | — | — | $CaCO_3$ | 2.8 | 4.1 | 332 | 1,010 |

TABLE 2

| | Magnetic powder | | | Binder polymer | | Ti coupling agent | | Inorganic compound powder | | | Iron loss (W/kg); B = 0.05T | |
|---|---|---|---|---|---|---|---|---|---|---|---|---|
| | Compostion (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| Example | | | | | | | | | | | | |
| No. 8 | Fe | 88 | 98.4 | Epoxy | 1.3 | Tetraoctylbis-(ditridecylphosphite)titanate | 0.3 | — | — | — | 242 | 613 |
| No. 9 | Fe | 88 | 97.5 | Epoxy | 1.8 | Tetraoctylbis-(ditridecylphosphite)titanate | 0.7 | — | — | — | 218 | 566 |
| No. 10 | 3.5% Si—Fe | 54 | 80.0 | Epoxy | 12.1 | Tetraoctylbis-(ditridecylphosphite)titanate | 2.0 | $CaCO_3$ | 2.8 | 4.9 | 147 | 322 |
| No. 11 | 3.5% Si—Fe | 54 | 75.0 | Epoxy | 23.0 | Tetraoctylbis-(ditridecylphosphite)titanate | 2.0 | — | — | — | 184 | 382 |
| No. 12 | 3.5% Si—Fe | 54 | 75.0 | Epoxy | 16.7 | Tetraoctylbis-(ditridecylphosphite)titanate | 2.0 | $SiO_2$ | 5.0 | 6.3 | 168 | 350 |
| No. 13 | Fe | 88 | 64.0 | Epoxy | 30.0 | Tetraoctylbis-(ditridecylphosphite)titanate | 4.0 | — | — | — | 122 | 309 |
| No. 14 | Fe | 88 | 55.0 | Epoxy | 41.0 | Tetraoctylbis-(ditridecylphosphite)titanate | 4.0 | — | — | — | 109 | 262 |
| Comparative Example | | | | | | | | | | | | |
| No. 30 | Fe | 88 | 98.4 | Epoxy | 1.6 | — | — | — | — | — | 298 | 822 |
| No. 31 | Fe | 88 | 97.5 | Epoxy | 2.5 | — | — | — | — | — | 258 | 710 |
| No. 32 | 3% Si—Fe | 54 | 80.0 | Epoxy | 15.1 | — | — | $CaCO_3$ | 2.8 | 4.9 | 309 | 890 |
| No. 33 | 3% Si—Fe | 54 | 75.0 | Epoxy | 25.1 | — | — | — | — | — | 284 | 798 |
| No. 34 | 3% Si—Fe | 54 | 75.0 | Epoxy | 18.7 | — | — | $SiO_2$ | 5.0 | 6.3 | 269 | 722 |

TABLE 2-continued

| | Magnetic powder | | | Binder polymer | | Ti coupling agent | | Inorganic compound powder | | | Iron loss (W/kg); B = 0.05T | |
|---|---|---|---|---|---|---|---|---|---|---|---|---|
| | Compostion (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| No. 35 | 3% Si—Fe | 54 | 64.0 | Epoxy | 36.0 | — | — | — | — | — | 287 | 706 |

TABLE 3

| | Magnetic powder | | | Binder polymer | | Ti coupling agent | | Inorganic compound powder | | | Iron loss (W/kg); B = 0.05T | |
|---|---|---|---|---|---|---|---|---|---|---|---|---|
| | Composition (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| Example | | | | | | | | | | | | |
| No. 15 | 45% Ni—Fe | 54 | 85 | Epoxy | 9.5 | Tetra(2,2-diallyloxymethyl-1-butyl)-bis(ditridecylphosphite)-titanate | 2.0 | $CaCO_3$ | 2.8 | 3.5 | 136 | 281 |
| No. 16 | 6.5% Si—Fe | 54 | 85 | Epoxy | 9.5 | Tetra(2,2-diallyloxymethyl-1-butyl)-bis(ditridecylphosphite)-titanate | 2.0 | $CaCO_3$ | 2.8 | 3.5 | 197 | 395 |
| No. 17 | 3.1% Al—Fe | 54 | 85 | Epoxy | 9.5 | Tetra(2,2-diallyloxymethyl-1-butyl)-bis(ditridecylphosphite)-titanate | 2.0 | $CaCO_3$ | 2.8 | 3.5 | 129 | 279 |
| No. 18 | 1.5% Si—Fe | 54 | 85 | Epoxy | 9.5 | Tetra(2,2-diallyloxymethyl-1-butyl)-bis(ditridecylphosphite)-titanate | 2.0 | $CaCO_3$ | 2.8 | 3.5 | 112 | 287 |
| Comparative Example | | | | | | | | | | | | |
| No. 36 | 45% Ni—Fe | 54 | 85 | Epoxy | 11.5 | — | — | $CaCO_3$ | 2.8 | 3.5 | 155 | 405 |
| No. 37 | 6.5% Si—Fe | 54 | 85 | Epoxy | 11.5 | — | — | $CaCO_3$ | 2.8 | 3.5 | 445 | 1,340 |
| No. 38 | 3.1% Al—Fe | 54 | 85 | Epoxy | 11.5 | — | — | $CaCO_3$ | 2.8 | 3.5 | 259 | 682 |
| No. 39 | 1.5% Si—Fe | 54 | 85 | Epoxy | 11.5 | — | — | $CaCO_3$ | 2.8 | 3.5 | 189 | 545 |

TABLE 4

| | Magnetic powder | | | Binder polymer | | Ti coupling agent | | Inorganic compound powder | | | Iron loss (W/kg); B = 0.05T | |
|---|---|---|---|---|---|---|---|---|---|---|---|---|
| | Composition (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| Example | | | | | | | | | | | | |
| No. 19 | Fe | 210 | 93.5 | Epoxy | 4.5 | Tetraoctylbis-(ditridecylphosphite)titanate | 2.0 | — | — | — | 221 | 747 |
| No. 20 | Fe | 180 | 93.5 | Epoxy | 4.5 | Tetraoctylbis-(ditridecylphosphite)titanate | 2.0 | — | — | — | 219 | 700 |
| No. 21 | Fe | 105 | 93.5 | Epoxy | 4.5 | Tetraoctylbis-(ditridecylphosphite)titanate | 2.0 | — | — | — | 133 | 422 |
| No. 22 | Fe | 88 | 93.5 | Epoxy | 4.5 | Tetraoctylbis-(ditridecylphosphite)titanate | 2.0 | — | — | — | 116 | 318 |
| No. 23 | 3.0% Si—Fe | 54 | 85.0 | Epoxy | 9.5 | Tetraoctylbis (ditridecylphosphite)titanate | 2.0 | $Al_2O_3$ | 10 | 3.5 | 151 | 336 |
| No. 24 | 3.0% Si—Fe | 54 | 85.0 | Epoxy | 9.5 | Tetraoctylbis-(ditridecylphos- | 2.0 | $Al_2O_3$ | 10 | 3.5 | 191 | 456 |

TABLE 4-continued

| | Magnetic powder | | | Binder polymer | | Ti coupling agent | | Inorganic compound powder | | | Iron loss (W/kg); B = 0.05T | |
|---|---|---|---|---|---|---|---|---|---|---|---|---|
| | Composition (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| | | | | | | phite)titanate | | | | | | |
| No. 25 | 1.5% Si—Fe | 54 | 85.0 | Polyamide | 13.0 | Isopropyltri-(N—aminoethyl-aminoethyl)-titanate | 2.0 | — | — | — | 115 | 342 |
| Comparative Example | | | | | | | | | | | | |
| No. 40 | 1.5% Si—Fe | 54 | 85.0 | Polyamide | 15.0 | — | — | — | — | — | 195 | 579 |

(1) In Example Nos. 1–7 and Comparative Example Nos. 26 to 29, the iron loss was measured while the composition, the average diameter and the mixing ratio of the magnetic powder were kept the same but the mixing ratios of the binder polymer, the Ti coupling agent, and the powder of an inorganic compound ($CaCO_3$) were varied.

As a result of these measurements, there was no great difference in the iron loss at 50 Hz in a commercial frequency range. However, regarding the iron loss at 50 kHz and 100 kHz within a high-frequency range, as can be seen from Table 1 above, the iron cores of Example Nos. 1 to 7 in which the Ti coupling agent was added in the amounts of 0.3% or more had smaller iron losses than those of Comparative Example Nos. 26 to 29. At 200 kHz, the iron core of Example No. 3 had an iron loss of 1,170 W/kg,while that of Comparative Example No. 28 had an iron loss of 4,060 W/kg, revealing a greater difference. Note that the Example wherein a portion of the binder polymer was replaced with $CaCO_3$ had a still smaller iron loss.

The difference in the iron loss within a high-frequency range including 50 kHz and 100 kHz in the Example and Comparative Example is an eddy current loss difference and is attributable to the electrical insulation state between the magnetic powder particles. This reveals the fact that the iron cores of the present invention have an excellent electrical insulating property.

Figure 3:
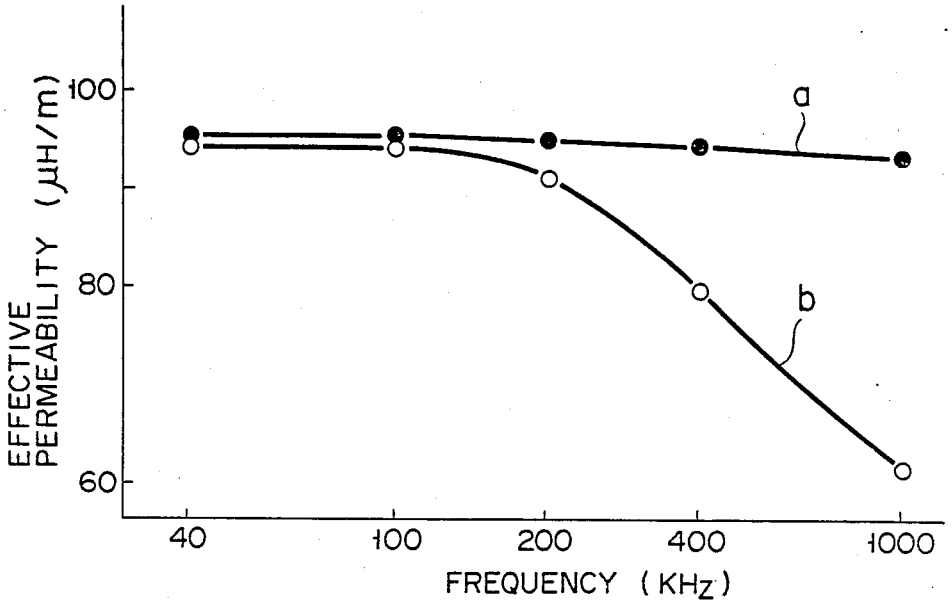
FIGS. 3 to 7 are graphs showing changes in effective magnetic permeability within a high-frequency range of an iron core of each Example of the present invention and of an iron core of each Comparative Example.

FIG. 3 shows the results obtained with the measurement of an effective permeability at respective frequencies (40 kHz to 1,000 kHz). Curve a in FIG. 3 corresponds to Example No. 3, while curve b corresponds to Comparative Example No. 28. The effective permeability of the iron core of Example No. 3 remained substantially the same over a wide frequency range of 40 kHz to 1,000 kHz. In contrast, to this, in the iron core of Comparative Example No. 28 which did not contain a Ti coupling agent, the effective permeability is significantly lowered in a high-frequency range. A similar tendency is seen between the iron core of Example No. 5 which contained $CaCO_3$ and the iron core of Comparative Example No. 29 which did not. Such a low eddy current means a low effective permeability within a high-frequency range.

Using the samples of the iron cores of Example No. 3 and Comparative Example No. 28, the releasing force from a mold for forming a formed body of the same shape and size was measured. The releasing force was 500 kg or less in Example No. 3 and was as high as 1,500 to 2,000 kg in Comparative Example No. 28. This fact revealed the facts that the addition of a Ti coupling agent can reduce the releasing force of a formed body from a mold to allow easy formation, and prevent damage to the formed body being released from the mold, thereby improving the manufacturing yield.

The iron core samples of Example Nos. 1 to 7 all had magnetic flux densities of 0.6 T or higher at a magnitizing force of 10,000 A/m.

(2) The iron loss was measured for the iron cores of Example Nos. 8 to 14 wherein the mixing ratio of the magnetic powder was varied within the range of 55.0 to 98.4% and a Ti coupling agent was added, and for those of Comparative Example Nos. 30 to 35 wherein the mixing ratio of the magnetic powder was also varied within a range of 64.0 to 98.4% and a Ti coupling agent was not used. The obtained results are shown in Table 2 above.

As can be seen from Table 2, when a comparison is made between the samples containing the same amount of magnetic powder, the iron cores of the Examples have a smaller iron loss, and a difference in iron loss between the Examples and Comparative Examples is enhanced at a frequency of 100 kHz. A particularly large difference in iron loss was seen between Example No. 10 and Comparative Example No. 32 in both of which a $CaCO_3$ powder was added as a powder of an inorganic compound and between Example No. 12 and Comparative Example No. 34 in both of which an $SiO_2$ powder was added as a powder of an inorganic compound.

The iron cores of these Examples exhibit magnetic flux densities of 0.5 T or higher at a magnetizing force of 10,000 A/m. However, in Example No. 14 in which the mixing ratio of the magnetic powder was less than 60%, although the iron loss was small, the magnetic flux density at a magnetizing force of 10,000 A/m was 0.4 T or less.

(3) The iron loss was measured for the iron cores of Examples 15 to 18 wherein the composition of the magnetic powder was varied and a Ti coupling agent was added, and for those of Comparative Examples 36 to 39 wherein the composition of the magnetic powder was similarly varied but a Ti coupling agent was not added. The obtained results are shown in Table 3. The iron cores of the Examples have smaller iron loss than the iron cores of the Comparative Examples at 50 kHz and 100 kHz. At 200 kHz, the iron core of Example No. 16 had an iron loss of 869 W/kg, that of Comparative Example No. 37 had an iron loss of 4,840 W/kg, that of Example No. 18 had an iron loss of 690 W/kg, and that of Comparative Example No. 39 had an iron loss larger than 1,400 W/kg.

Figure 4:
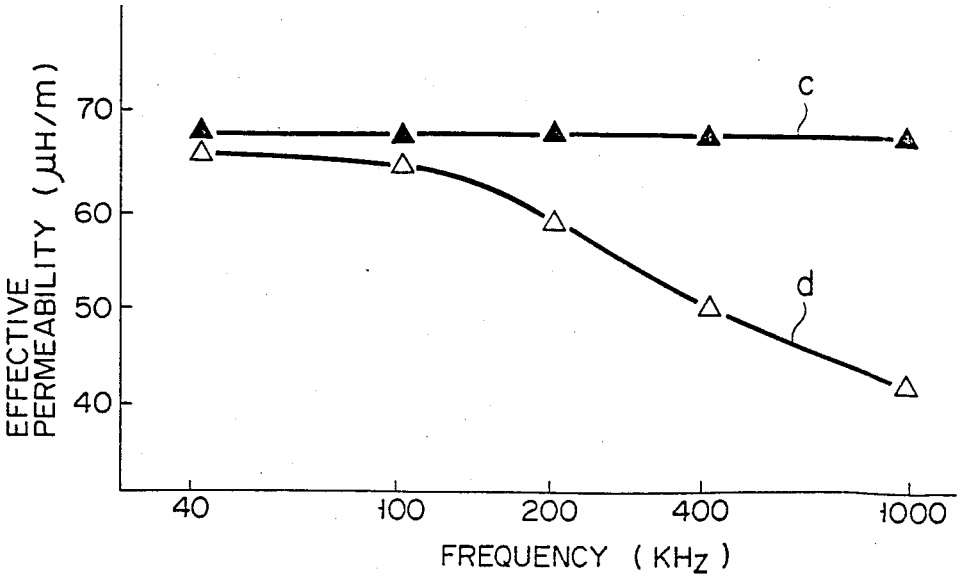

FIG. 4 is a graph showing changes in effective permeability in a frequency range of 40 kHz to 1,000 kHz. Curve c in FIG. 4 corresponds to Example No. 16, and curve d corresponds to Comparative Example No. 37. Although the iron core of the Example experiences substantially no decrease in effective permeability in a high-frequency range, the iron core of the Comparative Example experiences a substantial decrease in effective permeability within a frequency higher than 100 kHz. This also applies to Example No. 15 and Comparative Example No. 36, Example No. 17 and Comparative Example No. 38, and Example No. 18 and Comparative Example No. 39.

The iron cores of Example Nos. 15 to 18 all had magnetic flux densities of 0.6 T or higher at a magnetizing force of 10,000 A/m.

(4) The iron loss was measured for the iron core of Example Nos. 19 to 22 wherein the average diameter of the magnetic powder was varied, those of Example Nos. 23 and 24 wherein $Al_2O_3$ was used and was added in different orders, and for those of Example No. 25 and Comparative Example No. 40 wherein a polyamide resin was used as a binder polymer. The obtained results are shown in Table 4.

It is seen from the results obtained that the iron loss in a high-frequency range decreases with a decrease in an average diameter of the magnetic powder. However, the change in iron loss with changes in particle size was very small near a commercial frequency range. The iron loss of Example No. 23 wherein $Al_2O_3$ was dispersed in an epoxy resin before mixing it with other components had smaller iron loss and better characteristics than those of the iron core of Example No. 24 wherein $Al_2O_3$, a magnetic powder, a Ti coupling agent, and an epoxy resin were mixed simultaneously.

When a polyamide resin was used as a binder polymer, the iron core of Example No. 25 in which a Ti coupling agent was added had a smaller iron loss than that of the iron core of Comparative Example No. 40 wherein no such Ti coupling agent was added.

The iron cores of these Examples had magnetic flux densities of 0.6 T or higher at a magnetizing force of 10,000 A/m.

EXAMPLE NOS. 41–60

Iron cores were prepared following the same procedures as those in Example Nos. 1 to 25 using the compositions shown in Tables 5 to 8 below.

Except for Example No. 59, the powder of an inorganic compound used was dispersed in a binder polymer before mixing it with other components. In Example No. 59, all the components were mixed simultaneously.

The heat-treatment conditions, and measurement conditions for the magnetic properties such as iron loss, effective permeability, or magnetic flux density and releasing force from a mold were performed under the same conditions as those in Examples Nos. 1 to 40 described above.

TABLE 5

| | Magnetic powder | | | Binder polymer | | Silane coupling agent | | Inorganic compound powder | | | Iron loss (W/kg); B = 0.05T | |
|---|---|---|---|---|---|---|---|---|---|---|---|---|
| | Composition (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| Example | | | | | | | | | | | | |
| No. 41 | 3.5% Si—Fe | 54 | 85.0 | Epoxy | 14.7 | β-(3,4-epoxycyclohexyl)ethyltrimethoxysilane | 0.3 | — | — | — | 260 | 728 |
| No. 42 | 3.5% Si—Fe | 54 | 85.0 | Epoxy | 13.0 | β-(3,4-epoxycyclohexyl)ethyltrimethoxysilane | 2.0 | — | — | — | 202 | 549 |
| No. 43 | 3.5% Si—Fe | 54 | 85.0 | Epoxy | 11.5 | β-(3,4-epoxycyclohexyl)ethyltrimethoxysilane | 3.5 | — | — | — | 208 | 562 |
| No. 44 | 3.5% Si—Fe | 54 | 85.0 | Epoxy | 10.3 | β-(3,4-epoxycyclohexyl)ethyltrimethoxysilane | 0.7 | $CaCO_3$ | 2.8 | 4.0 | 202 | 508 |
| No. 45 | 3.5% Si—Fe | 54 | 85.0 | Epoxy | 8.4 | β-(3,4-epoxycyclohexyl)ethyltrimethoxysilane | 3.5 | $CaCO_3$ | 2.8 | 3.1 | 151 | 377 |
| Comparative Example | | | | | | | | | | | | |
| No. 61 | 3.5% Si—Fe | 54 | 85.0 | Epoxy | 14.9 | β-(3,4-epoxycyclohexyl)ethyltrimethoxysilane | 0.1 | — | — | — | 313 | 958 |
| No. 62 | 3.5% Si—Fe | 54 | 85.0 | Epoxy | 10.8 | β-(3,4-epoxycyclohexyl)ethyltrimethoxysilane | 0.1 | $CaCO_3$ | 2.8 | 4.1 | 289 | 879 |
| No. 63 | 3.5% Si—Fe | 54 | 85.0 | Epoxy | 15.0 | — | — | — | — | — | 368 | 1,127 |
| No. 64 | 3.5% Si—Fe | 54 | 85.0 | Epoxy | 10.9 | — | — | $CaCO_3$ | 2.8 | 4.1 | 332 | 1,010 |

TABLE 6

| | Magnetic powder | | | Binder polymer | | Silane coupling agent | | Inorganic compound powder | | | Iron loss (W/kg); B = 0.05T | |
|---|---|---|---|---|---|---|---|---|---|---|---|---|
| | Composition (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| Example | | | | | | | | | | | | |
| No. 46 | Fe | 88 | 98.4 | Epoxy | 1.3 | γ-glycidoxypropyl-trimethoxysilane | 0.3 | — | — | — | 197 | 597 |
| No. 47 | Fe | 88 | 97.5 | Epoxy | 1.8 | γ-glycidoxypropyl-trimethoxysilane | 0.7 | — | — | — | 177 | 537 |
| No. 48 | 3.5% Si—Fe | 54 | 75.0 | Epoxy | 23.0 | γ-glycidoxypropyl-trimethoxysilane | 2.0 | — | — | — | 196 | 432 |
| No. 49 | 3.5% Si—Fe | 54 | 75.0 | Epoxy | 16.7 | γ-glycidoxypropyl-trimethoxysilane | 2.0 | $SiO_2$ | 5.0 | 6.3 | 186 | 388 |
| No. 50 | 3.5% Si—Fe | 54 | 64.0 | Epoxy | 22.9 | γ-glycidoxypropyl-trimethoxysilane | 4.0 | $CaCO_3$ | 2.8 | 9.1 | 190 | 389 |
| No. 51 | 3.5% Si—Fe | 54 | 55.0 | Epoxy | 30.1 | γ-glycidoxypropyl-trimethoxysilane | 4.0 | $CaCO_3$ | 2.8 | 10.9 | 211 | 430 |
| Comparative Example | | | | | | | | | | | | |
| No. 65 | Fe | 88 | 98.4 | Epoxy | 1.6 | — | — | — | — | — | 298 | 822 |
| No. 66 | Fe | 88 | 97.5 | Epoxy | 2.5 | — | — | — | — | — | 258 | 710 |
| No. 67 | 3.5% Si—Fe | 54 | 75.0 | Epoxy | 25.0 | — | — | — | — | — | 284 | 798 |
| No. 68 | 3.5% Si—Fe | 54 | 75.0 | Epoxy | 18.7 | — | — | $SiO_2$ | 5.0 | 6.3 | 269 | 722 |
| No. 69 | 3.5% Si—Fe | 54 | 64.0 | Epoxy | 32.7 | — | — | $CaCO_3$ | 2.8 | 12.5 | 298 | 759 |

TABLE 7

| | Magnetic powder | | | Binder polymer | | Silane coupling agent | | Inorganic compound powder | | | Iron loss (W/kg); B = 0.05T | |
|---|---|---|---|---|---|---|---|---|---|---|---|---|
| | Composition (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| Example | | | | | | | | | | | | |
| No. 52 | 45% Ni—Fe | 54 | 85.0 | Epoxy | 9.5 | γ-glycidoxypropyl-trimethoxysilane | 2.0 | $CaCO_3$ | 2.8 | 3.5 | 143 | 312 |
| No. 53 | 6.5% Si—Fe | 54 | 85.0 | Epoxy | 9.5 | γ-glycidoxypropyl-trimethoxysilane | 2.0 | $CaCO_3$ | 2.8 | 3.5 | 207 | 439 |
| No. 54 | 3.1% Al—Fe | 54 | 85.0 | Epoxy | 9.5 | γ-glycidoxypropyl-trimethoxysilane | 2.0 | $CaCO_3$ | 2.8 | 3.5 | 136 | 293 |
| Comparative Example | | | | | | | | | | | | |
| No. 70 | 45% Ni—Fe | 54 | 85.0 | Epoxy | 11.5 | — | — | $CaCO_3$ | 2.8 | 3.5 | 155 | 405 |
| No. 71 | 6.5% Si—Fe | 54 | 85.0 | Epoxy | 11.5 | — | — | $CaCO_3$ | 2.8 | 3.5 | 445 | 1,340 |
| No. 72 | 3.5% Al—Fe | 54 | 85.0 | Epoxy | 11.5 | — | — | $CaCO_3$ | 2.8 | 3.5 | 259 | 682 |

TABLE 8

| | Magnetic powder | | | Binder polymer | | Silane coupling agent | | Inorganic compound powder | | | Iron loss (W/kg); B = 0.05T | |
|---|---|---|---|---|---|---|---|---|---|---|---|---|
| | Composition (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| Example | | | | | | | | | | | | |
| No. 55 | Fe | 180 | 93.5 | Epoxy | 4.5 | γ-glycidoxypropyl-trimethoxysilane | 2.0 | — | — | — | 208 | 710 |
| No. 56 | Fe | 105 | 93.5 | Epoxy | 4.5 | γ-glycidoxypropyl-trimethoxysilane | 2.0 | — | — | — | 160 | 460 |
| No. 57 | Fe | 88 | 93.5 | Epoxy | 4.5 | γ-glycidoxypropyl-trimethoxysilane | 2.0 | — | — | — | 110 | 302 |
| No. 58 | 3.5% Si—Fe | 54 | 85.0 | Epoxy | 9.5 | γ-glycidoxypropyl-trimethoxysilane | 2.0 | $Al_2O_3$ | 10 | 3.5 | 159 | 373 |
| No. 59 | 3.5% Si—Fe | 54 | 85.0 | Epoxy | 9.5 | γ-glycidoxypropyl-trimethoxysilane | 2.0 | $Al_2O_3$ | 10 | 3.5 | 193 | 433 |
| No. 60 | 1.5% Si—Fe | 54 | 85.0 | Poly-amide | 13.0 | γ-aminopropyltri-ethoxysilane | 2.0 | — | — | — | 121 | 360 |
| Comparative | | | | | | | | | | | | |

TABLE 8-continued

| | Magnetic powder | | | Binder polymer | | Silane coupling agent | | Inorganic compound powder | | | Iron loss (W/kg); B = 0.05T | |
|---|---|---|---|---|---|---|---|---|---|---|---|---|
| | Composition (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume) | 50 kHz | 100 kHz |
| Example No. 73 | 1.5% Si—Fe | 54 | 85.0 | Polyamide | 15.0 | — | — | — | — | — | 195 | 579 |

(1) The iron loss was measured for the iron cores of Example Nos. 41 to 45 and Comparative Example Nos. 61 to 64 wherein the composition, average particle size, and mixing ratio of the magnetic powder were kept the same, while the mixing ratios of the binder polymer, the silane coupling agent, and the powder of the inorganic compound ($CaCO_3$) were varied. The obtained results are shown in Table 5.

Each sample had substantially the same iron loss at 50 Hz in a commercial frequency range. However, at 50 kHz and 100 kHz in a high-frequency range, the iron loss of Example Nos. 41 to 45 in which the silane coupling agent was added in the amounts of 0.3% or more was smaller than that of Comparative Example Nos. 61 to 64 wherein the silane coupling agent was added in amounts less than 0.3%. Particularly at 200 kHz, the iron core of Example No. 43 had an iron loss of 1,290 W/kg while that of Comparative Example No. 63 had an iron loss of 4,060 W/kg. Thus, the higher the frequency, the greater the difference in the iron loss of iron cores of the Example and Comparative Example. An iron core wherein a portion of the binder polymer is replaced with $CaCO_3$ had a still smaller iron loss.

Figure 5:
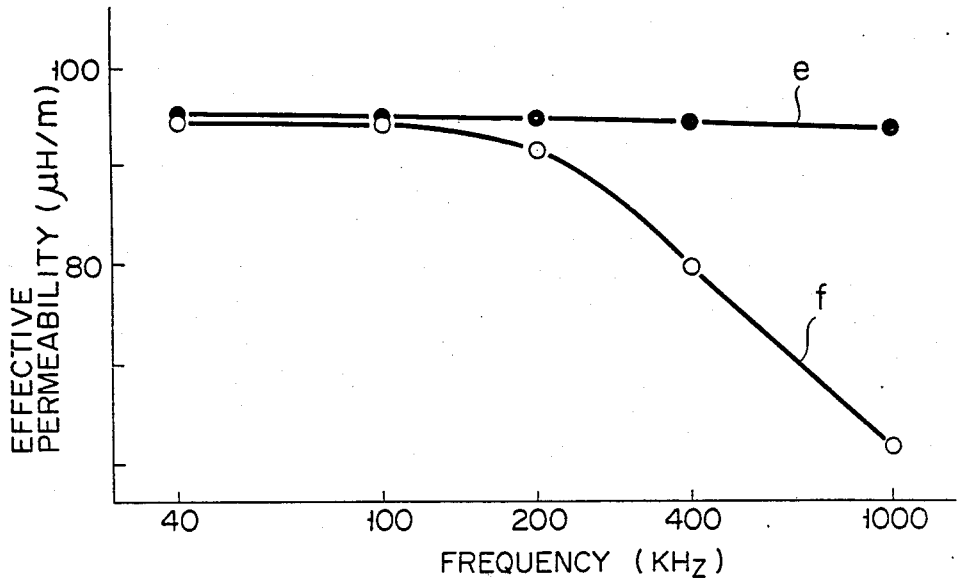

FIG. 5 is a graph showing changes in effective permeability within a frequency range of 40 kHz to 1,000 kHz. Curve e in FIG. 5 corresponds to Example No. 43, while curve f corresponds to Comparative Example No. 63. As can be seen from this graph, the iron core of Example No. 43 experiences substantially no change in effective permeability within a wide frequency range. However, in the iron core of Comparative Example No. 63 wherein no silane coupling agent is used, the effective permeability significantly decreased within the high-frequency range. The effective permeability was measured up to a high-frequency range for the iron cores of Example No. 45 and Comparative Example No. 64 in both of which $CaCO_3$ was added. A similar tendency as that shown in FIG. 5 was also observed.

The releasing force of a formed body from the mold was measured for Example No. 43 and Comparative Example No. 63. The iron core of Example No. 43 required a releasing force of 700 kg or less, and that of Comparative Example No. 63 required a releasing force of 1,500 to 2,000 kg.

The iron cores of Example Nos. 41 to 45 had magnetic flux densities of 0.6 T or higher at a magnetizing force of 10,000 A/m.

(2) The iron loss was measured for the iron cores of Example Nos. 46 to 51 wherein the mixing ratio of the magnetic powder was varied within a range of 55.0 the 98.4% and a silane coupling agent was added, and for the iron cores of Comparative Example Nos. 65 to 69 wherein the mixing ratio of the magnetic powder was varied within a range of 64.0 to 98.4% and no silane coupling agent was added. The obtained results are shown in Table 6.

As can be seen from Table 6, when a comparison is made between iron cores having the same mixing ratio of the magnetic powder, iron cores of the Examples have a smaller iron loss than those of the Comparative Examples. The difference in iron loss is particularly enhanced at 100 kHz. With iron cores of the Examples containing an $SiO_2$ or $CaCO_3$ powder as a powder of an inorganic compound, they have considerably smaller iron loss than those of the Comparative Example having the same magnetic powder mixing ratio.

The iron cores of these Examples have magnetic flux densities of 0.5 T or higher at a magnetizing force of 10,000 A/m. However, in Example No. 51 wherein the mixing ratio of the magnetic powder is less than 60%, although the iron loss is small, the magnetic flux density at a magnetizing force of 10,000 A/m was 0.4 T or less.

(3) The iron loss was measured for the iron cores of Example Nos. 52 to 54 wherein the magnetic powder composition was varied amd a silane coupling agent was added, and for those of Comparative Example Nos. 70 to 72 wherein the composition of the magnetic powder was similarly changed but no silane coupling agent was added. The obtained results are shown in Table 7. As can be seen from this table, the iron cores of the present invention had smaller iron loss at 50 kHz and 100 kHz. In particular, the iron core of Example No. 53 had an iron loss of 1,010 W/kg at 200 kHz. However, at the same frequency, the iron core of Comparative Example No. 71 had an iron loss of 4,840 W/kg, providing a big difference from that of the Example.

Figure 6:
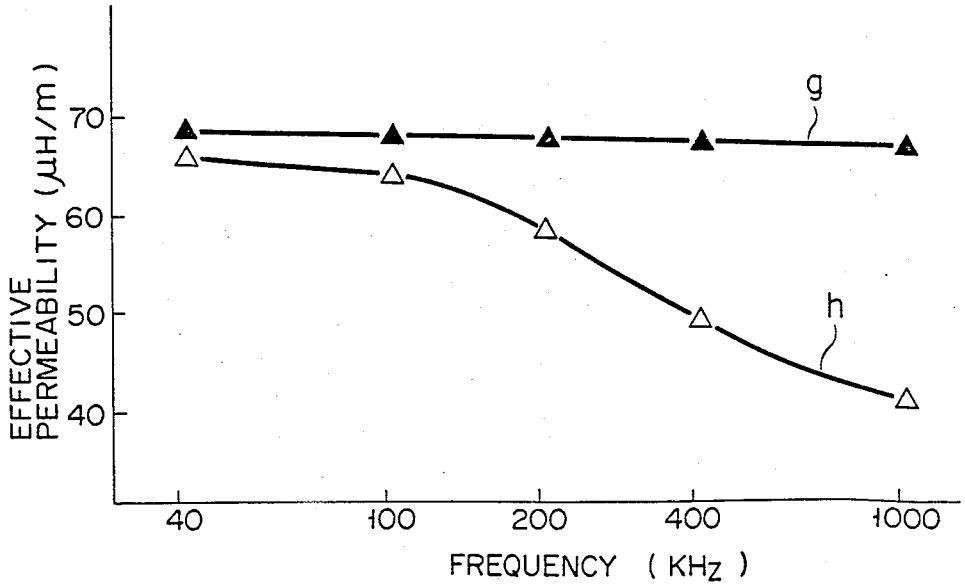

FIG. 6 is a graph showing changes in effective permeability within a frequency range of 40 kHz to 1,000 kHz. Curve g in FIG. 6 corresponds to Example No. 53, and curve h corresponds to Comparative Example No. 71. The iron core of the present invention experienced substantially no decrease in effective permeability even within a high-frequency range. However, the iron core of the Comparative Example 71 underwent a significant decrease in effective permeability at frequencies about 100 kHz. This substantially applied to Example No. 52 and Comparative Example No. 70, and Example No. 54 and Comparative Example No. 72.

The iron cores of Example Nos. 52 to 54 had magnetic flux densities of 0.6 T or higher at a magnetizing force of 10,000 A/m.

(4) The iron loss was measured for the iron cores of Example Nos. 55 to 57 wherein the average diameter of the magnetic powder was varied, the iron cores of Example Nos. 58 and 59 wherein the addition timing of $Al_2O_3$ was varied, and the iron cores of Example No. 60 and Comparative Example No. 73 wherein a polyamide resin was used as a binder polymer. The obtained results are shown in Table 8.

It is seen from the obtained results that a change in iron loss due to changes in particle diameter is small near a commercial frequency range, but the smaller the average diameter of the magnetic powder the smaller the iron loss in a high-frequency range.

As for the time to add a powder of an inorganic compound, the iron core of Example No. 58 wherein $Al_2O_3$ was dispersed in the epoxy resin had a smaller iron loss than that of the iron core of Example No.59 wherein $Al_2O_3$, the magnetic powder, the silane coupling agent, and the epoxy resin were mixed together simultaneously.

When a polyamide resin is used as a binder polymer, the iron core of Example No. 60 in which a silane coupling agent was added had a smaller iron loss than that of Comparative Example No. 73 wherein no silane coupling agent was added.

The iron core of these Example had excellent magnetic flux densities of 0.6 T or higher at a magnetizing force of 10,000 A/m.

EXAMPLE NOS. 61-62

Figure 7:
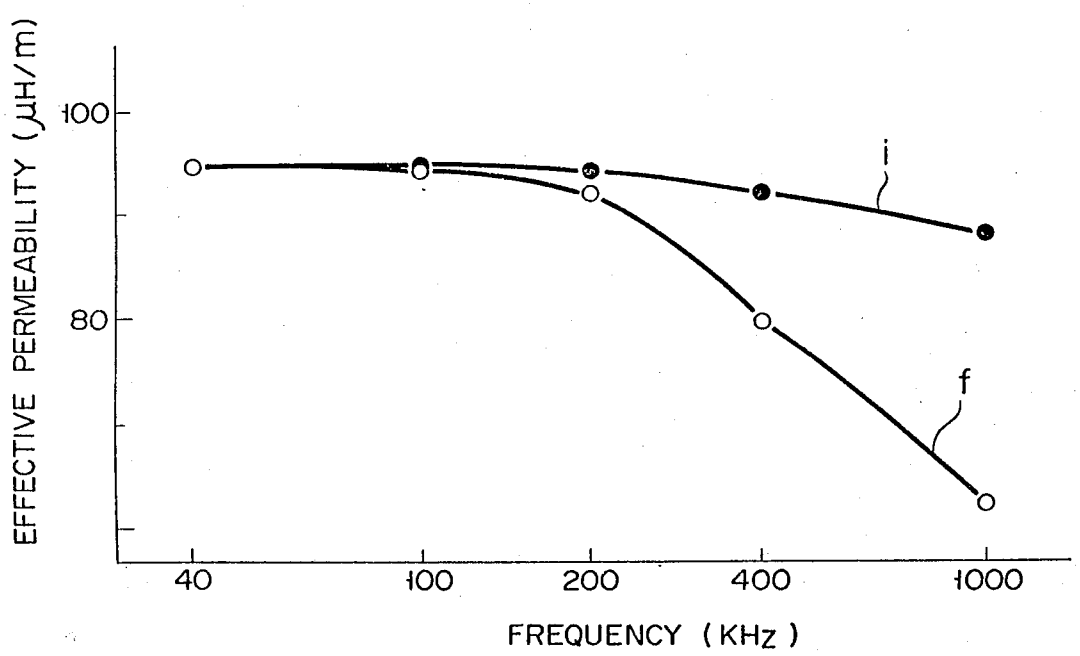

Iron cores were prepared following the same procedures as those in Example Nos. 1 to 25 and using the components shown in Table 9. The powder of an inorganic compound was dispersed in a binder polymer. The heat-treatment conditions, and measurement conditions for magnetic properties such as iron loss, effective permeability, and magnetic flux density, and a releasing force from a mold were the same as those in Example Nos. 1 to 25. The obtained results are shown in Table 9.

that of Comparative Example No. 64 had the same tendencies as that in FIG. 7.

The releasing force of a formed body from a mold after formation was measured for the iron cores of Example No. 61 and Comparative Example No. 63. The iron core of Example No. 61 required a releasing force of only 700 kg or less, which was less than half that of Comparative Example No. 63.

The iron cores of Example Nos. 61 and 62 both had magnetic flux densities of 1.0 T or higher at a magnetizing force of 10,000 A/m.

In addition to the iron cores described above, another iron core was prepared using as a magnetic powder a powder of an Fe—Si—Al alloy called cendust having an average diameter of 73 μm, a polycarbonate resin as a binder polymer, and a Ti coupling agent. This iron core had an iron loss at 100 kHz of about ⅓ of an iron core prepared similarly but without addition of the Ti coupling agent.

Still another iron core was prepared in accordance with a conventional method using powders of an Fe—Co alloy and an Fe—Si—B amorphous alloy and mixing them with a binder polymer and a coupling agent. The resultant iron core had a very small iron loss within a high-frequency range of 50 kHz or higher, a small effective permeability within the high-frequency range, and a very low releasing force from a mold after compression and formation therein.

As can be seen from the above description, when a powder core is manufactured from a magnetic powder composition of the present invention, the surface of each magnetic powder particle is covered with the

TABLE 9

| | Magnetic powder | | | Binder polymer | | Al coupling agent | | Inorganic compound powder | | | Iron loss (W/kg); B = 0.05T | |
|---|---|---|---|---|---|---|---|---|---|---|---|---|
| Example | Composition (% by weight) | Average particle diameter (μm) | Mixing ratio (% by volume) | Type | Mixing ratio (% by volume) | Type | Mixing ratio (% by volume) | Type | Average particle diameter (μm) | Mixing ratio (% by volume | 50 kHz | 100 kHz |
| No. 61 | 3.5% Si—Fe | 54 | 85.0 | Epoxy | 13.0 | Ethyl acetoacetate aluminum diisopropylate | 2.0 | — | — | — | 249 | 659 |
| No. 62 | 3.5% Si—Fe | 54 | 85.0 | Epoxy | 8.4 | Ethyl acetoacetate aluminum diisopropylate | 3.5 | $CaCO_3$ | 2.8 | 3.1 | 181 | 452 |

A comparison was made between Example Nos. 61 and 62 and Comparative Example Nos. 63 and 64 shown in Table 5 above. As a result of such a comparison, the iron loss at 50 Hz was seen to be substantially the same for all these iron cores. However, at 50 kHz and 100 kHz in a high-frequency range, the iron core of Example No. 61 had a smaller iron loss than that of Comparative Example No. 63. The difference in iron loss between these iron cores is particularly notable at 100 kHz. The iron core of Example No. 62 wherein a powder of an inorganic compound was added had a still smaller iron loss.

FIG. 7 shows changes in effective permeability within a frequency range of 40 to 1,000 kHz. Curve i in FIG. 7 corresponds to Example No. 61, and curve f corresponds to Comparative Example No. 63 and is the same as the curve in FIG. 5. The iron core of Example No. 61 experiences substantially no change in effective permeability over a wide frequency range. The iron core of Example No. 62 in which $CaCO_3$ was added and coupling agent. Owing to the lipophilic function of the coupling agent, the binder polymer has a good wettability, dispersibility and bindability with respect to the magnetic powder. Of iron loss, an eddy current loss component increases in proportion to a square of the frequency, and most of the iron loss in a high-frequency range is attributed to the eddy current loss. However, since the iron core of the present invention has an excellent electric insulating property due to the presence of the binder polymer between the adjacent magnetic powder particles, the iron loss due to an eddy current loss component can be reduced. Furthermore, since the iron core of the present invention has a small iron loss in a high-frequency range, heat generation is suppressed, a decrease in effective permeability is not experienced, and a high magnetic flux density can be maintained. In addition to these advantages, the releasing force from the mold after compression can be small, and the workability is improved.

What is claimed is:

1. A magnetic powder core consisting essentially of:

(a) a powder of a soft magnetic metal or alloy, or a mixture of these, said magnetic metal or alloy comprising pure iron, alloys of Fe—Si, Fe—Al, Fe—Si—Al, Fe—Ni or Fe—Co, or an amorphous magnetic alloy selected from the group consisting of at least one element of Fe, Co, Ni, Nb, and at least one element of Si, B, and C, and said powder having an average particle size of 10–300 μm;

(b) an electrically insulating binder polymer for binding the powder; and (c) a coupling agent consisting of an organo-metallic compound for coupling the powder and the binder polymer, said coupling agent being selected from the group consisting of (i) a titanium coupling agent having the formula:

$$R_m—Ti—X_n$$

wherein R is a readily hydrolyzable group selected from the group consisting of a monoalkoxy, hydroxyacetic acid and ethylene glycol group; X is a lipophilic hydrocarbon group which is not readily hydrolyzable, and m and n are positive integers such that $4 \leqq m+n \leqq 6$ and $1 \leqq m \leqq 4$,; (ii) a silane coupling agent having the formula:

$$(RO)_n—\overset{\overset{(CH_3)_{3-n}}{|}}{Si}—X$$

wherein RO is a lower alkoxy group, X is an organofunctional group, and n is 2 or 3; and (iii) an aluminum coupling agent having the formula:

$$(RO)_n—Al—X_{3-n}$$

wherein RO is an alkoxyl group, X is a lipophilic group, and n is 1 or 2.

2. The magnetic powder core according to claim 1, further comprising a powder of an electrically insulating inorganic compound.

3. The magnetic powder core according to claim 2, wherein said electrically insulating inorganic compound is selected from the group consisting of calcium carbonate, magnesium carbonate, magnesia, silica, alumina, mica and glass.

4. The magnetic powder core according to claim 3, wherein said electrically insulating inorganic compound is contained in the amount of 0.3 to 30% by volume based on the total volume of the composition, and has an average particle size of less than 20 μm.

5. The magnetic powder core according to claim 2, wherein the compound of the inorganic powder is added in an amount of 0.3 to 30% by volume.

6. The magnetic powder core according to claim 1, wherein the coupling agent is added in an amount of at least 0.3% by volume of the composition.

7. The magnetic powder core according to claim 1, wherein the powder of the soft magnetic metal or alloy is added in an amount of 55 to 99% by volume.

8. The magnetic powder core according to claim 1, wherein the binder polymer is added in an amount of at least 0.7% by volume.

9. A powder core obtained by compressing and forming the magnetic powder composition of claim 1 into a predetermined shape and heat-treating the compressed composition at a sufficient temperature to cure the binder polymer.

10. The magnetic powder core according to claim 1, wherein said magnetic metal or alloy powder has a specific electrical resistance of from 10 μΩ-cm to several tens of μΩ-cm.

11. The magnetic powder core according to claim 1, wherein said electrically insulating binder polymer is an epoxy resin, a polyamide resin, a polyimide resin, a polyester resin or a polycarbonate resin.

12. The magnetic powder core according to claim 1, wherein said organic functional group P of the silane coupling agent is an epoxy group, a methacryl group or an amino group.

13. The magnetic powder core according to claim 1, wherein said titanium coupling agent is selected from the group consisting of isopropyltriisostearoyl titanate, dicumylphenyloxyacetate titanate, 4-aminobenzenesulfonyl dodecylbenzenesulfonyl ethylene titanate, isopropyl tri(N-aminoethyl-amino-ethyl) titanate, tetraoctyl bis(ditridecylphosphite) titanate and tetra(2,2-diallyloxymethyl-1-butyl) bis(ditridecylphosphite) titanate.

14. The magnetic powder core according to claim 1, wherein said aluminum coupling agent is ethylacetoacetate aluminum diisopropylate.

15. The magnetic powder core according to claim 1, wherein said silane coupling agent is selected from the group consisting of γ-glycidoxypropyl trimethoxysilane, β-(3,4-epoxycyclohexyl) ethyltrimethoxysilane, γ-aminopropyl triethoxysilane and N-β-(aminoethyl)-γ-aminopropyl methyldimethoxysilane.

* * * * *